US005524564A

United States Patent [19]

Porada

[11] Patent Number: 5,524,564

[45] Date of Patent: Jun. 11, 1996

[54] CATAMARAN ADAPTED FOR USE AS A SCUBA DIVING PLATFORM

[76] Inventor: William M. Porada, 2785 Pacific Coast Hwy., #E-244, Torrance, Calif. 90505

[21] Appl. No.: 386,924

[22] Filed: Feb. 10, 1995

[51] Int. Cl.[6] ..... B63B 1/00

[52] U.S. Cl. ..... 114/61; 114/270; 114/315

[58] Field of Search ..... 114/61, 315, 270; 405/186

[56] References Cited

U.S. PATENT DOCUMENTS

| | | | |
|---|---|---|---|
| 3,791,327 | 2/1974 | Devency | 114/315 |
| 4,854,257 | 8/1989 | Grayson | 114/315 |
| 5,082,464 | 1/1992 | Clink | 114/315 |

*Primary Examiner* Jesus D. Sotelo
*Attorney, Agent, or Firm* Herbert M. Shapiro

[57] ABSTRACT

A pontoon for a catamaran includes recesses for a plurality of scuba tanks where the tanks protrude above the top surfaces of the pontoon. The exposed portions of each of an adjacent pair of tanks provide a support for a mating removable seat back. Each tank is supported by a platform at the bottom of each recess below which is a chamber which includes an air-inflatable bladder. Each bladder includes an air hose with means to connect the hose to an air supply such as a scuba tank. The air is used to expand the bladder to expel any water which may accumulate in the chamber. The pontoon not only provides increased comfort for passengers but also provides for increased seaworthiness. The structure is compatible with collapsible and self trailoring catamaran configurations.

13 Claims, 9 Drawing Sheets

CATAMARAN ADAPTED FOR USE AS A SCUBA DIVING PLATFORM

FIELD OF THE INVENTION

This invention relates to a boat hull structure adapted for scuba diving and, more particularly, to a catamaran with such boat hulls which provides a particularly stable platform for scuba divers and their equipment.

BACKGROUND OF THE INVENTION

Catamarans are well known and available commercially. Collapsable and towable catamarans are also well known as is evidenced by, for example, U.S. Pat. No. 4,813,366 issued Mar. 21, 1989 and U.S. Pat. No. 5,313,908 issued May 24, 1994. Typically, a catamaran includes a pair of spaced-apart, elongated pontoons secured in position by fore and aft cross braces, with or without longitudinal braces, with a platform secured to the cross braces.

The pontoons usually are hollow, providing storage room in some catamarans and even providing sleeping room in large catamarans. The present invention is directed at small catamarans which may be collabsable and self trailering.

BRIEF DESCRIPTION OF THE INVENTION

In accordance with the principles of this invention, a pontoon structure for a catamaran is designed to hold a plurality of scuba tanks in upright positions and protruding above the top surface of the pontoon. The protruding portions of the scuba tanks are used as supports for mating seat backs which slip over the exposed portions of each pair of scuba tanks.

The pontoon is fitted with a cylindrical recess for each scuba tank. Each recess has a lower platform on which a scuba tank rests and below which is a chamber which includes an expandable bladder. An air hose is connected to the bladder and includes, at it,s distal end, a fitting for attachment to a scuba tank or any source of air. The bladder can be inflated to fill the chamber and thus exhaust any water which may have accumulated there. An individual chamber may be formed beneath each cylindrical recess or a community chamber may be defined beneath all cylindrical recesses in which case only a single bladder need be used.

The arrangement not only provides secure storage for a large number of scuba tanks but also uses those tanks for increased comfort and for ensuring seaworthiness of the boat.

DETAILED DESCRIPTION OF ILLUSTRATIVE EMBODIMENTS OF THIS INVENTION

Figure 1:
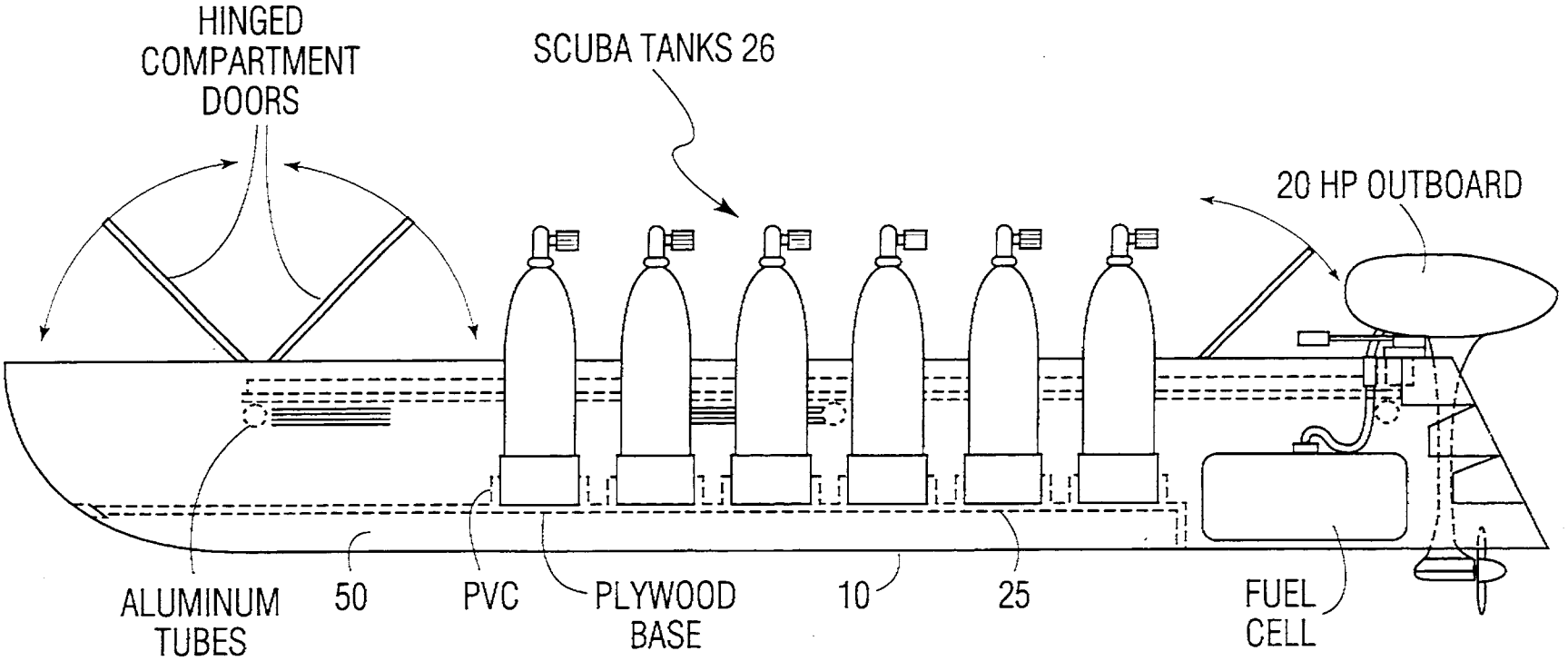
FIGS. 1–4 are side, top, front and rear views of a catamaran in accordance with principles of this invention.

FIG. 1 is a schematic side view of a catamaran pontoon 10 in accordance with the principles of this invention. The pontoon, in the preferred embodiment herein, is sixteen feet long and two feet wide as indicated in the figure.

Figure 2:
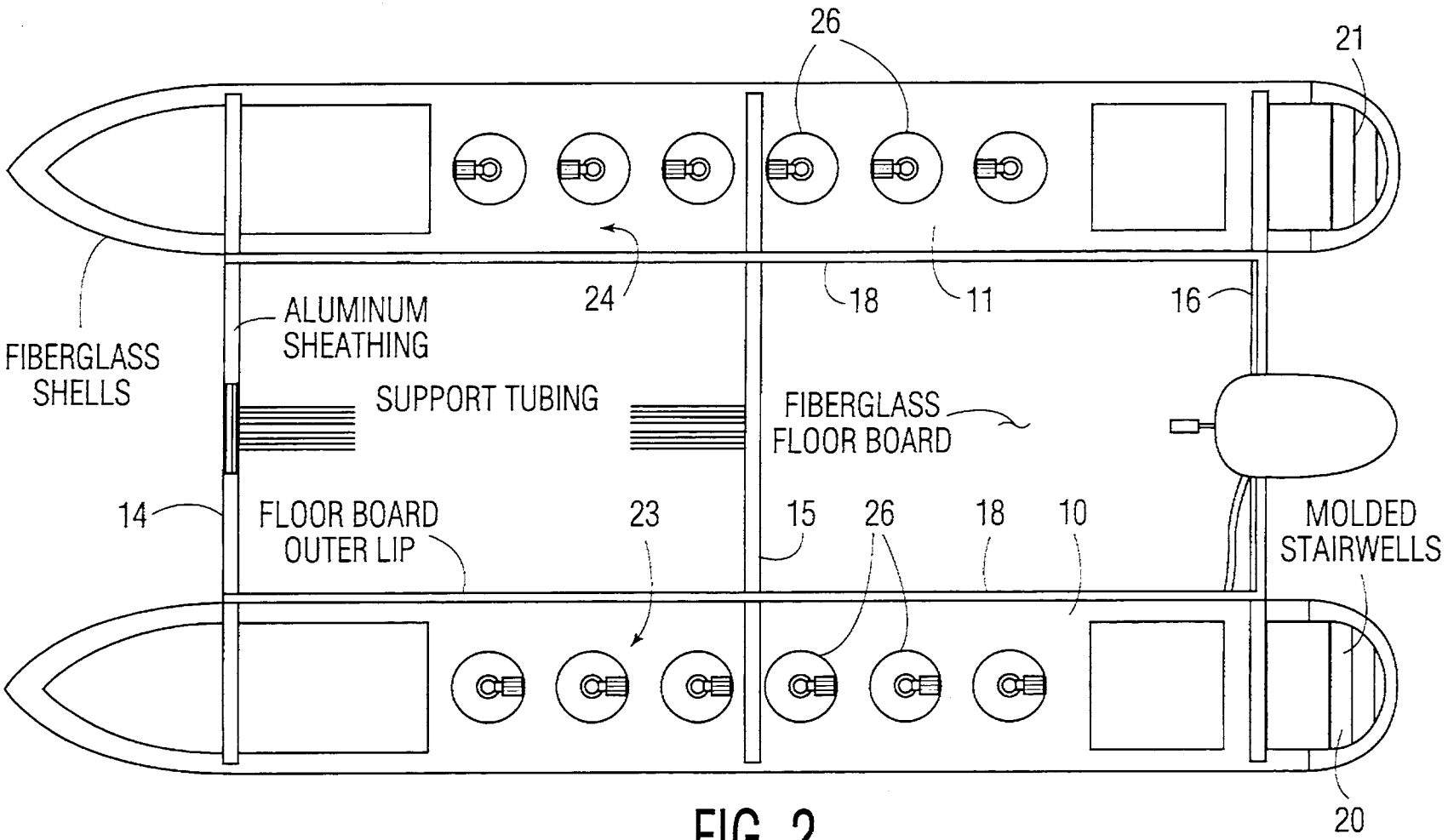

FIG. 2 is a schematic top view of a catamaran including two pontoons, 10 and 11, both of the type shown in FIG. 1. The two pontoons are fixed in a spaced-apart, parallel relationship by support members 14, 15 and 16 which attach to the pontoons and define a support for a platform (not shown) which mates with outer lip 18. Each pontoon conveniently includes a rear stairwell, 20 and 21, for pontoons 10 and 11 respectively. Each pontoon is two feet wide.

As is clear from FIGS. 1 and 2, each pontoon is fitted with a plurality (six as shown) of cylindrical recesses, accessable from the top surfaces 23 and 24 of pontoons 10 and 11 respectively. The recesses terminate, at their lower ends, at a floor or platform 25 conveniently of marine plywood or other suitable material. The recesses have cylindrical geometries to receive scuba tanks 26 which, as can be seen in figures, protrude beyond the top surfaces of the pontoons in the preferred embodiment.

Figure 3:
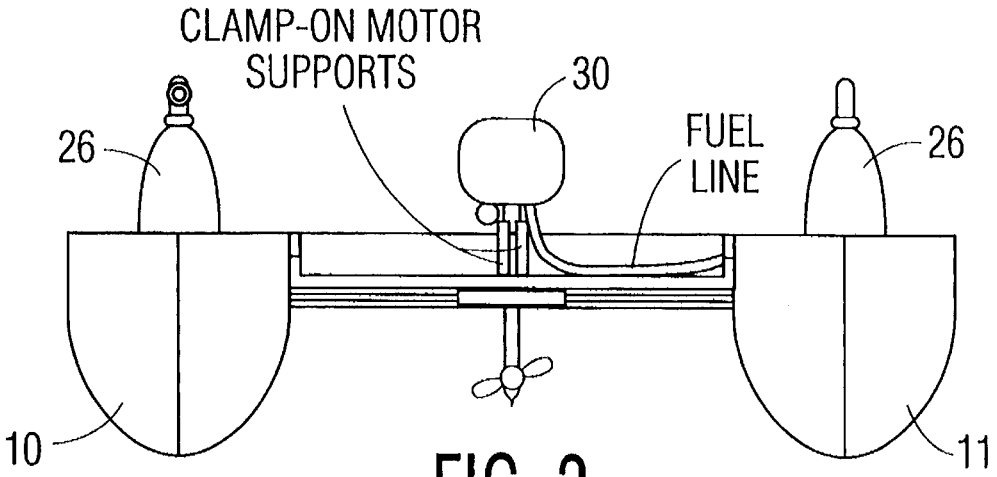
Figure 4:
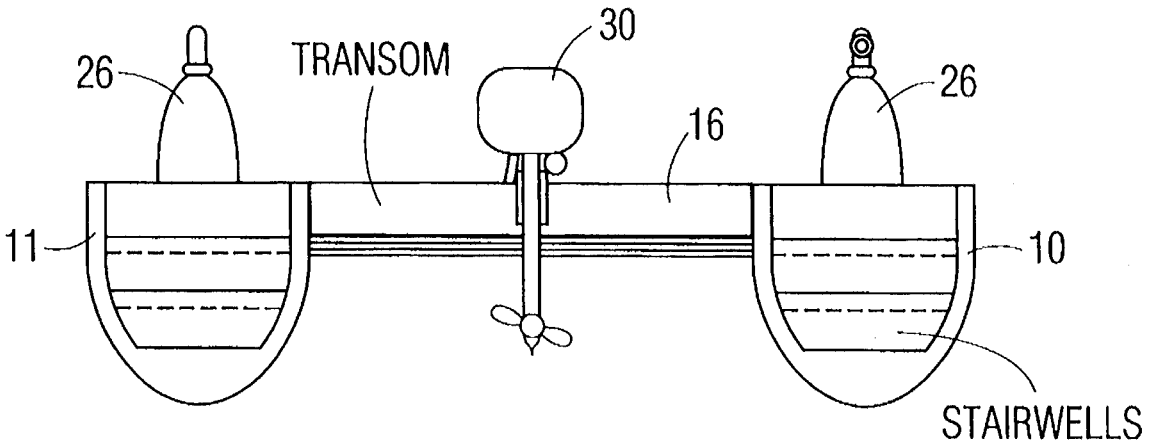

FIGS. 3 and 4 show, schematically, the front and rear views, respectively, of the catamaran of FIG. 2. The rear support 16 can be seen to function as a transom on which an outboard motor 30 can be attached.

Figure 5:
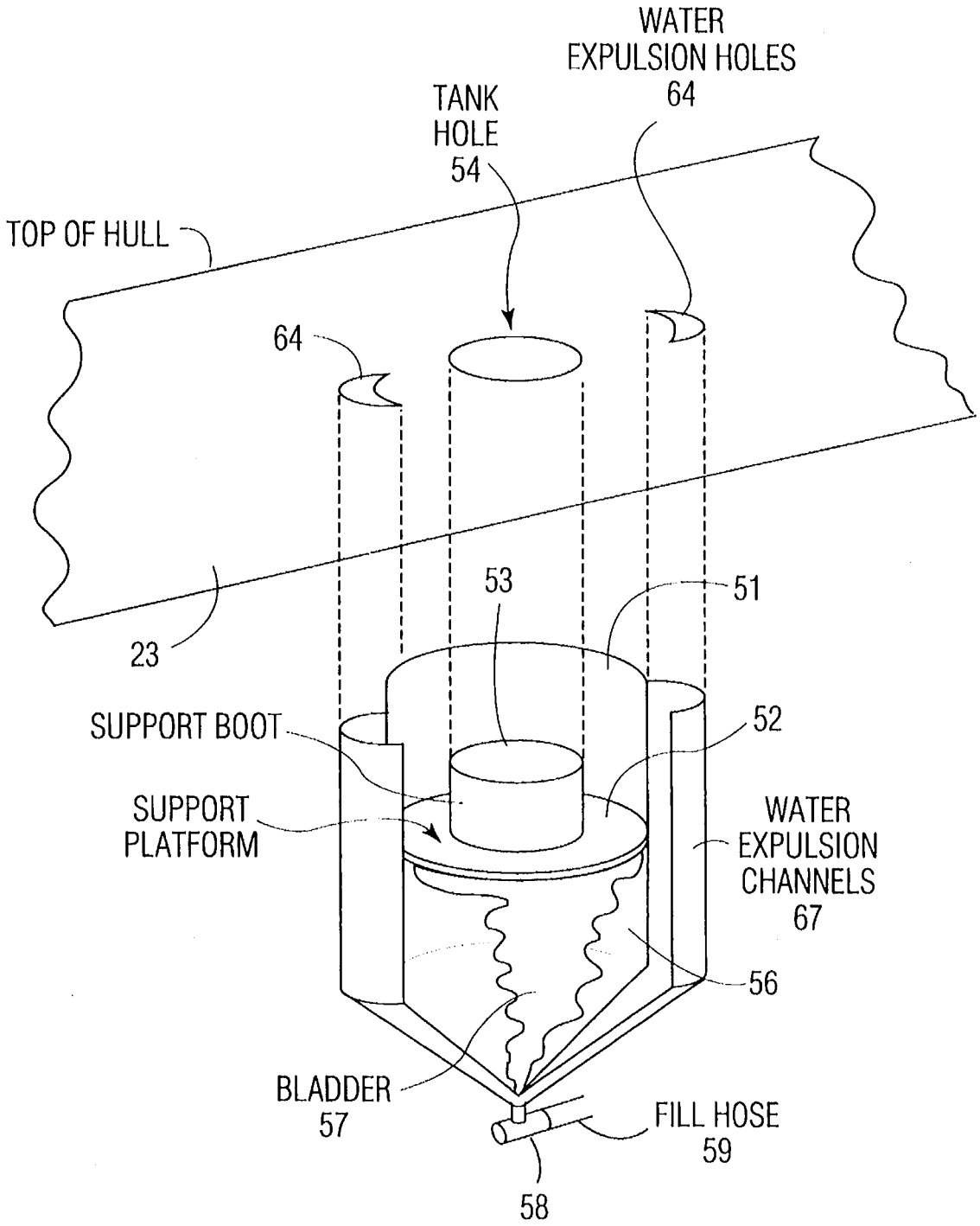
FIGS. 5–10 are schematic views of the scuba tank holder assembly showing the structure thereof with a water-exhausting bladder in various levels of expansion during operation.

In a preferred embodiment,the chamber 50, formed between platform 25 and the hull of a pontoon (10) of FIG. 1, is divided into sections or chambers, each of which includes an inflatable bladder. An illustrative geometry for such a chamber is shown in FIG. 5. Specifically, FIG. 5 shows an illustrative cylindrical recess 51, with a platform 52 at it's lower end. Platform 52 has a boot 53 attached to it for receiving a scuba tank. The top surface of the pontoon includes a hole 54 through which a scuba tank protrudes.

Platform 52 defines a chamber 56 containing a bladder 57. The bladder is fitted, at it's lower extremity, with an air hose attachment 58. A hose 59 is connected to the attachment to provide a path for inflating the bladder. The hose includes a fitting at it's distal end for attachment to a scuba tank or to an alternate air supply indicated at 60 in FIG. 6.

Figure 6:
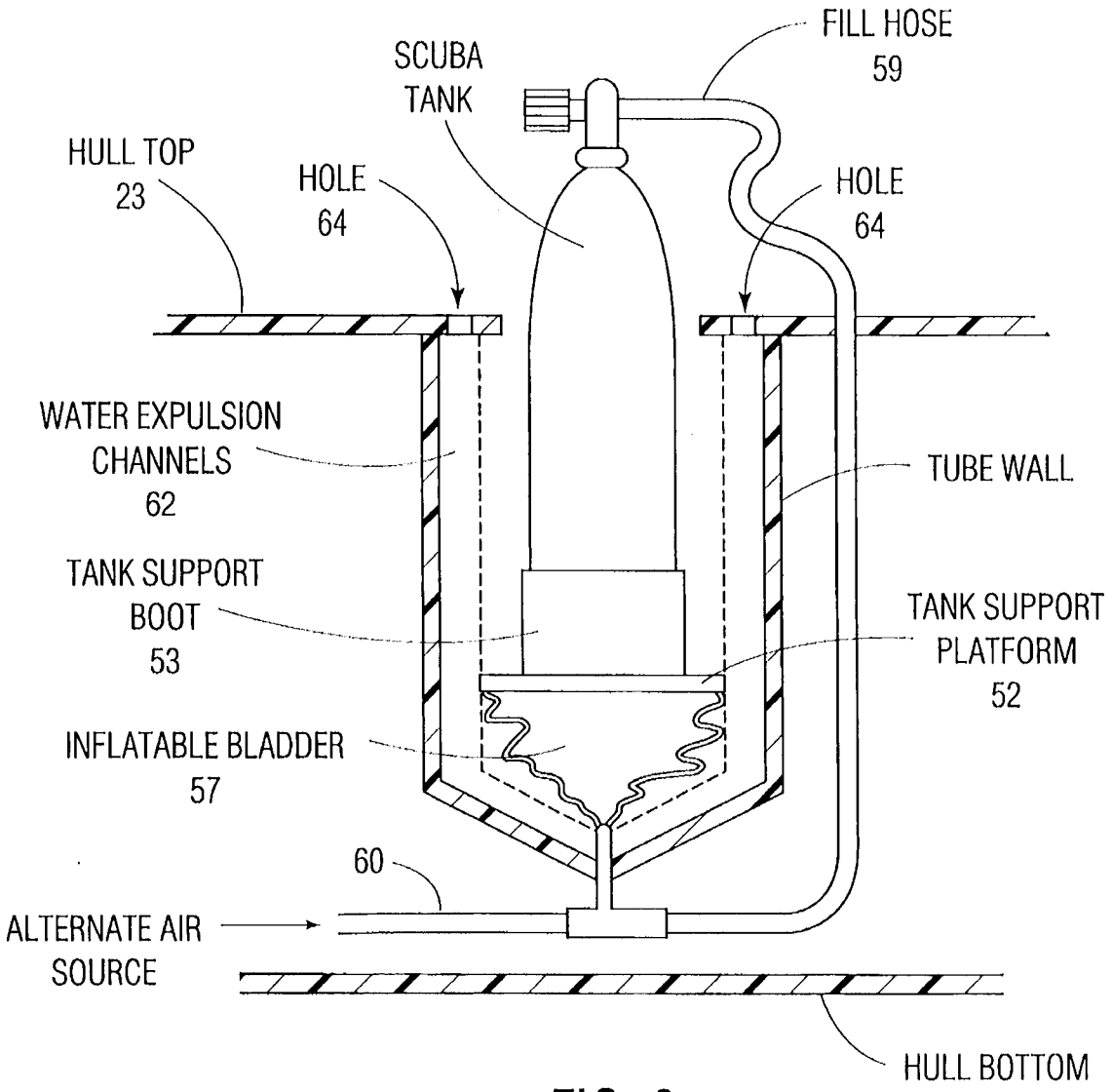

FIGS. 5 and 6 also show water expansion channels 62. The channels provide an exit channel for water being forced out of chamber 56 when the bladder in the chamber is expanding. The channels terminate at holes 64 in the top surface of the pontoon as shown in FIGS. 5 and 6.

Figure 7:
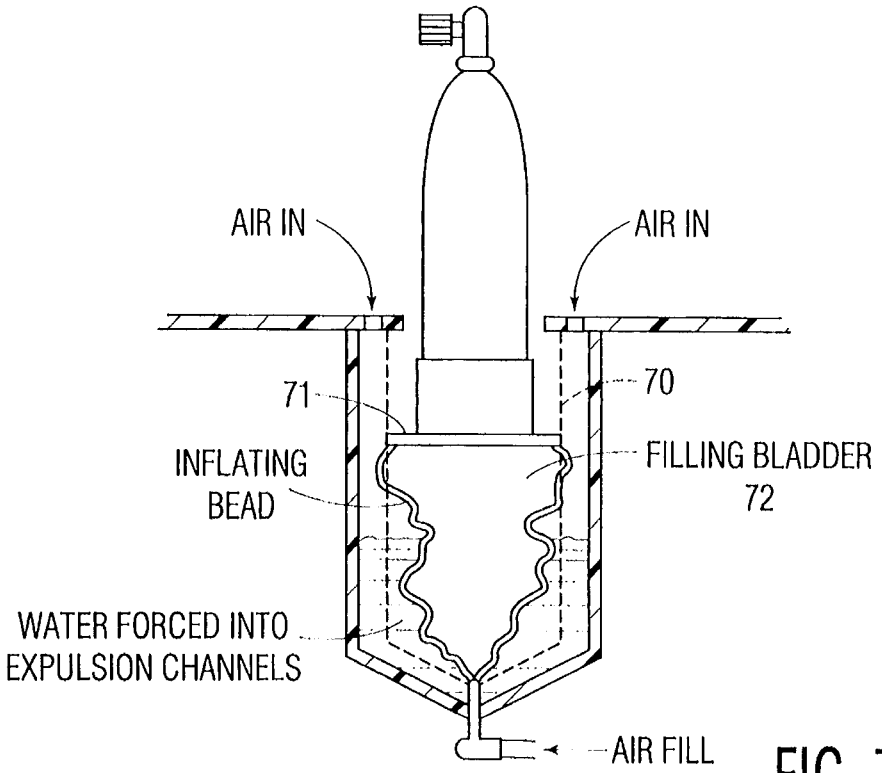
Figure 8:
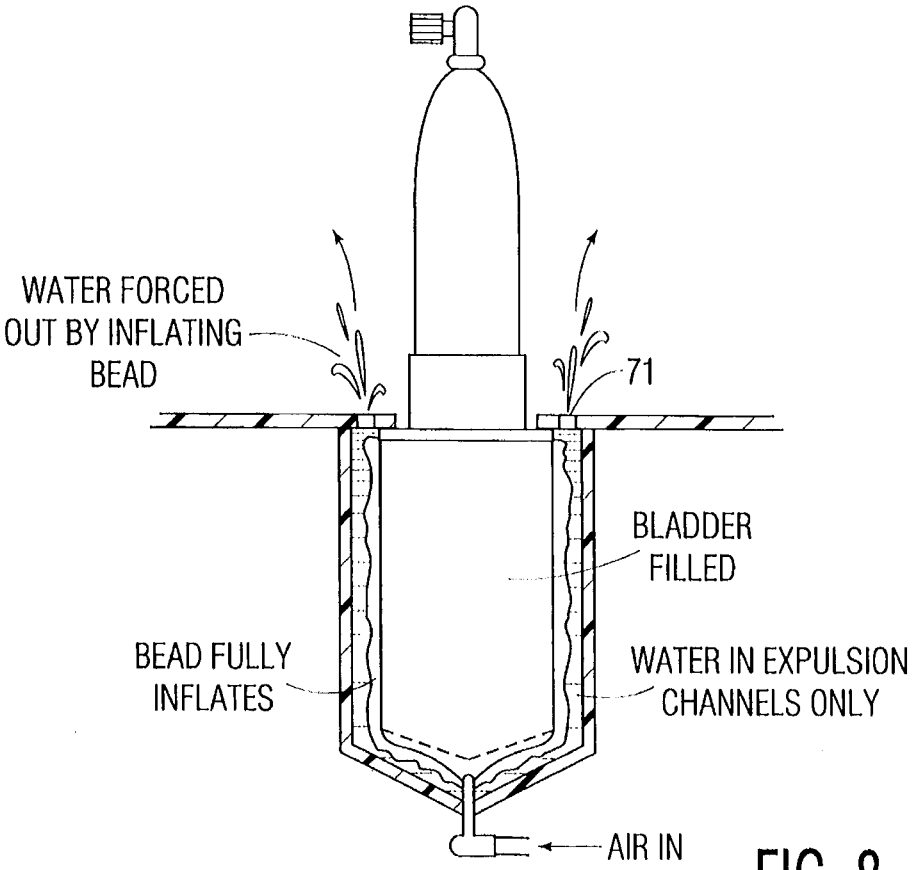
Figure 9:
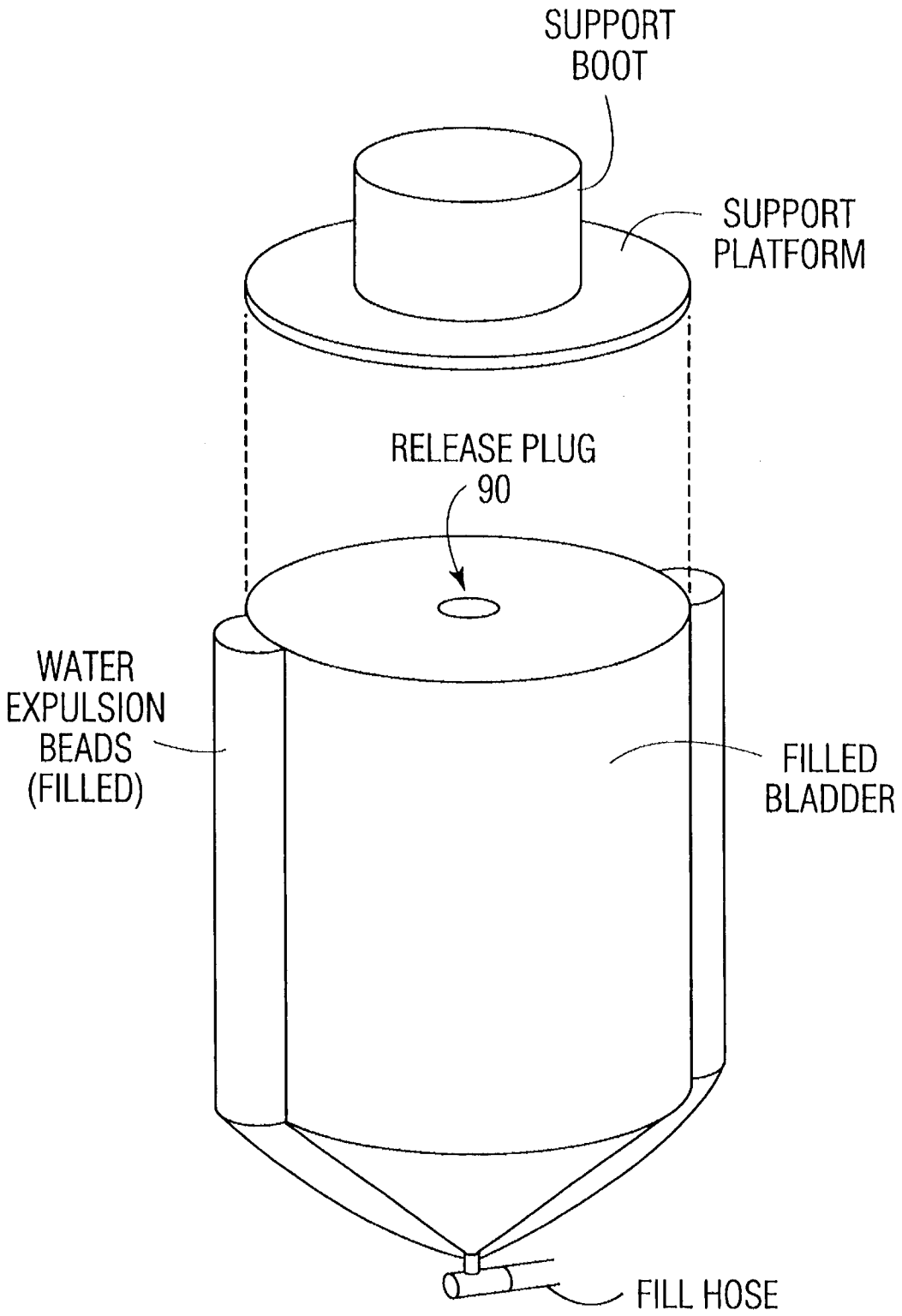

FIGS. 7 and 8 show an embodiment where the cylindrical recess 70 is fitted with a lower platform which is movable along a vertical axis as viewed in FIG. 67. In this embodiment, a bladder 72 is sufficiently large to fill the entire vertical recess when inflated. FIG. 8 depicts the situation when the bladder is fully inflated. It can be seen that, in an emergency situation,virtually the entire internal cavity of the potoon can be filled with air eliminating any water which may have accumulated there. With the bladder fully inflated, the platform (71) is positioned just below the top surface of the pontoon as shown in FIG. 8 with the scuba tank completely protruding from it's recess. The top of the bladder conveniently includes a release plug 90 as shown in FIG. 9 with support platform 71 including an aperture (not shown) for accessing the plug.

Figure 10:
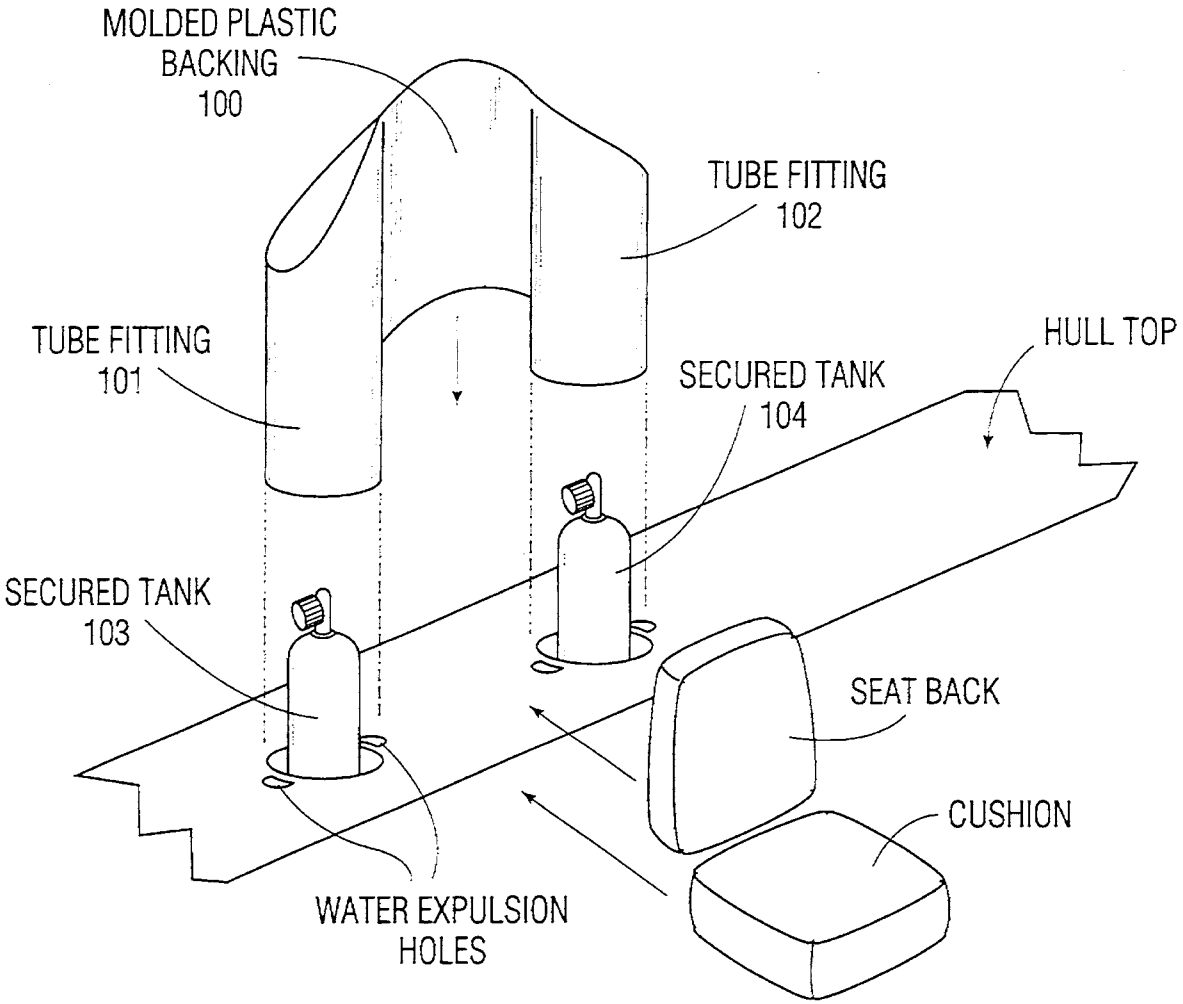

FIG. 10 shows a molded back support 100 which includes side sleeves or fittings 101 and 102 for slipping over a pair of adjacent protruding scuba tanks 103 and 104 as shown in the figure. Support 100 can be shaped to receive seat and back cushions for providing a considerable degree of comfort for a relatively small catamaran rigged for scuba diving.

Figure 11:
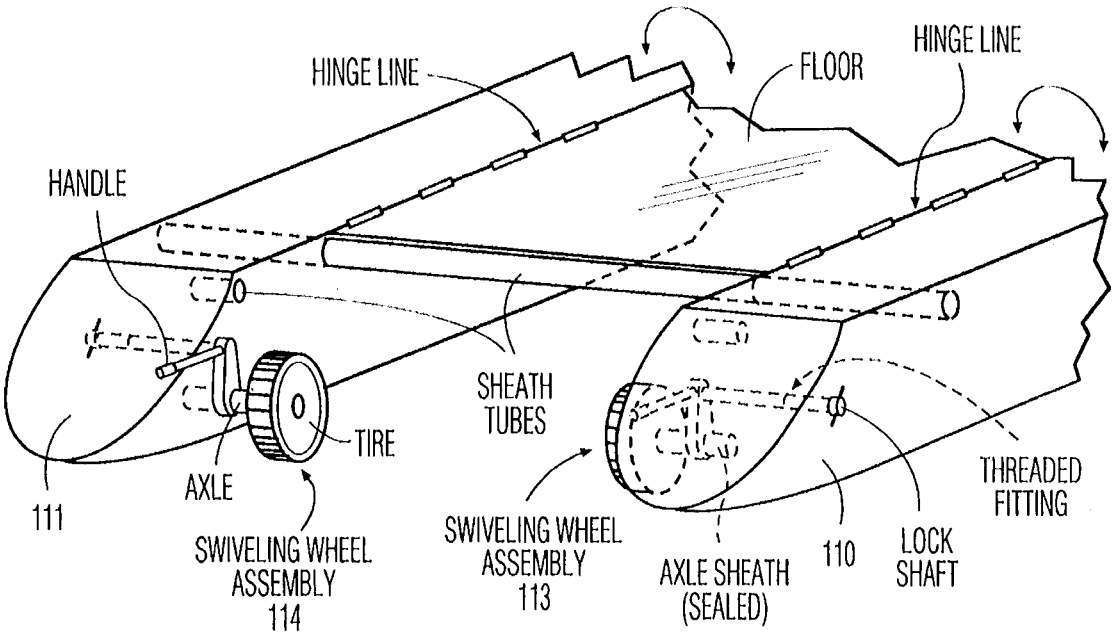
FIGS. 11 and 12 are schematic views of a self-trailoring arrangement for the catamaran of FIGS. 1–10.
Figure 12:
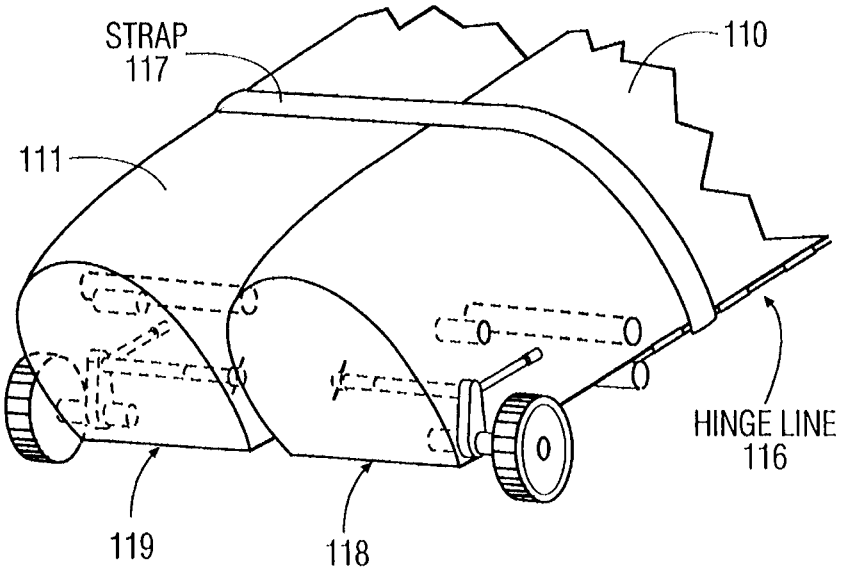

The entire catamaran herein can be made of fiber glass and can be made collapsable and self towing by including swivel wheel assemblies or swiveling pontoons with attached wheels assemblies. The latter arrangement is shown in FIGS. 11 and 12. FIG. 11 shows the position of two pontoons 110 and 111 when in a spaced-apart position for use. It can be seen that wheel assemblies 113 and 114 are positioned above the bottoms of the hulls. FIG. 12 shows the pontoons swivelled upwards at hinge lines 116 and strapped in place by straps 117 so that the wheels extend below the bottom of the hulls as shown. With the pontoons in the swivelled-up position of FIG. 12, of course, the top surfaces 118 and 119 of the pontoons are facing downwards and the wheels are positioned below those faces to contact the ground when the catamaran is being trailored.

The invention has been described in terms of a catamaran, but it should be clear that an individual pontoon, in accordance with this invention, could be used in other than a catamaran configuration as with outriggers.

What is claimed is:

1. A catamaran having first and second pontoons and means for securing said pontoons in spaced-apart, parallel positions, at least one of said pontoons having a top surface and at least one having a vertical cylindrical recess therein for receiving a scuba tank, said recess having a lower platform for forming a support for said tank and for defining a chamber therebeneath, said chamber including an air-fillable bladder of a geometry to fill said entire chamber when inflated, said bladder having an air hose connected thereto and including at its distal end a fitting for connection to an air supply, said chamber also including a water exhaust path for exhausting water from said chamber when said bladder is being filled with air.

2. A catamaran as in claim 1 wherein each of said first and second pontoons has a top surface and includes at least one vertical cylindrical recess for receiving a scuba tank.

3. A catamaran as in claim 2 wherein each of said pontoons includes a plurality of vertical cylindrical recesses for receiving scuba tanks and each of said recesses includes a lower platform for said tanks and for defining a chamber therebeneath, each of said pontoons including an air-fillable bladder for expelling water from said chamber.

4. A catamaran as in claim 3 wherein each of said pontoons includes an individual lower platform for each of said recesses for defining individual chambers therebeneath, said pontoons including an air-fillable bladder in at least some of said chambers, said bladders including air hoses for connection to the respective scuba tanks.

5. A catamaran as in claim 4 wherein the lower platforms in said vertical cylindrical recesses are positioned such that scuba tanks therein extend above the top surfaces of said pontoons.

6. A catamaran as in claim 5 also including at least one back support, said back support including means for removably engaging the exposed portions of a pair of adjacent scuba tanks for supporting the back of a passenger.

7. A catamaran as in claim 2 wherein each of said pontoons includes a plurality of vertical cylindrical recesses for receiving scuba tanks, and said recesses have a common lower platform for defining a single chamber therebeneath, each of said pontoons including a single air-fillable bladder for exhausting water from said common chamber.

8. A catamaran as in claim 7 wherein the lower platform of said vertical cylindrical recesses is positioned such that scuba tanks therein extend above the top surfaces of said pontoons.

9. A catamaran as in claim 1 wherein said platform is movable along a vertical axis and said bladder is of a size to occupy said entire cylindrical recess when inflated.

10. A catamaran as in claim 1 wherein each of said pontoons includes a wheel assembly, said catamaran including means for swivelling said pontoons for positioning said wheel assembly above the bottoms of the pontoons when the pontoons are in a fixed, spaced-apart position for floating and beneath the pontoons when the pontoons are strapped in close proximity for trailering.

11. A pontoon having a top surface and a plurality of vertical cylindrical recesses for receiving scuba tanks, each of said recesses having a lower platform for supporting a tank and for defining a chamber therebeneath, each of said chambers including therein an air-fillable bladder for expelling water from said chamber, said bladder including means for attaching said bladder to an air supply.

12. A pontoon as in claim 11 wherein each of said platforms is movable along a vertical axis and each of said bladders is of a size to occupy the entire cylindrical recess when inflated.

13. A pontoon as in claim 11 wherein said platform for each of said recesses comprises a single platform and said single platform is movable along a vertical axis and said bladder is of a size to occupy the entire space of said cylindrical recesses when filled.

* * * * *